US012565777B2

(12) United States Patent
Torrejón Puchol et al.

(10) Patent No.: US 12,565,777 B2
(45) Date of Patent: Mar. 3, 2026

(54) DEVICE FOR A VENTILATED FACADE

(71) Applicant: SISTEMAS TECNICOS DEL ACCESORIO Y COMPONENTES, S.L., A Coruña (ES)

(72) Inventors: Carlos Torrejón Puchol, A Coruña (ES); José Antonio Isorna Vilachán, A Coruña (ES); Juan Carlos Fernández Padrón, A Coruña (ES)

(73) Assignee: SISTEMAS TECNICOS DEL ACCESORIO Y COMPONENTES, S.L., A Coruña (ES)

( * ) Notice: Subject to any disclaimer, the term of this patent is extended or adjusted under 35 U.S.C. 154(b) by 195 days.

(21) Appl. No.: 18/692,685

(22) PCT Filed: Sep. 1, 2022

(86) PCT No.: PCT/ES2022/070551

§ 371 (c)(1),
(2) Date: Mar. 15, 2024

(87) PCT Pub. No.: WO2023/041821

PCT Pub. Date: Mar. 23, 2023

(65) Prior Publication Data

US 2025/0003223 A1 Jan. 2, 2025

(30) Foreign Application Priority Data

Sep. 17, 2021 (ES) ..... ES202131842U

(51) Int. Cl.
*E04F 13/08* (2006.01)

(52) U.S. Cl.
CPC ..... *E04F 13/0819* (2013.01); *E04F 13/083* (2013.01)

(58) Field of Classification Search
CPC ..... E04F 13/0819; E04F 13/083; E04F 13/08; E04F 13/0821; E04F 13/07; E04F 13/072;
(Continued)

(56) References Cited

U.S. PATENT DOCUMENTS 4,522,003 A * 6/1985 Akihama ..... E04F 13/081 52/235
5,018,323 A * 5/1991 Clausen ..... E04F 13/12 248/222.51

(Continued)

FOREIGN PATENT DOCUMENTS

DE 102021103756 A1 9/2021
EP 0180837 A2 5/1986

(Continued)

*Primary Examiner* — Beth A Stephan
(74) *Attorney, Agent, or Firm* — Hayes Soloway, PC

(57) ABSTRACT

A device for a ventilated facade includes a plurality of panels provided with at least two hooking elements, at least one upright profile intended to be attached to a building, wherein the U-shaped upright profile, a hanger for each hooking element secured with the possibility of sliding and frontally to the upright profile, which is configured to hold the panel and wherein the hanger is provided with a central cavity, wherein the hooking element is housed in the central cavity in an assembly situation, enabling the hanger to be frontally assembled to the upright profile and access to the connecting element. Thus, it is possible to adjust the panels in height without the need for disassembly and at any stage of the installation, even after having finished their installation.

11 Claims, 8 Drawing Sheets

(58) Field of Classification Search
CPC . E04F 13/075; E04F 13/0801; E04F 13/0835; E04F 13/0851; E04B 2/30
See application file for complete search history.

(56) References Cited

U.S. PATENT DOCUMENTS

| | | | | |
|---|---|---|---|---|
| 9,016,020 | B1 * | 4/2015 | Yang | E04F 13/0803 52/511 |
| 9,926,707 | B1 * | 3/2018 | Knight, Jr | E04F 13/0891 |
| 10,138,635 | B1 * | 11/2018 | Yeo | E04F 13/083 |
| 11,162,265 | B2 * | 11/2021 | Hatzinikolas | E04F 13/142 |
| 2002/0124514 | A1 * | 9/2002 | Higgins | E04F 13/083 52/235 |
| 2003/0126818 | A1 * | 7/2003 | Chung | E04F 13/083 52/481.2 |
| 2012/0186170 | A1 * | 7/2012 | Macdonald | E04F 13/083 52/173.3 |
| 2015/0020468 | A1 * | 1/2015 | Wickstrom | E04B 2/7457 52/745.1 |
| 2015/0055831 | A1 | 2/2015 | Kawasaki et al. | |
| 2015/0308123 | A1 * | 10/2015 | Prica | E04F 13/0889 52/483.1 |
| 2016/0289977 | A1 * | 10/2016 | Lucchese | E04F 13/0819 |
| 2017/0002572 | A1 * | 1/2017 | Wagner | E04F 13/0821 |
| 2017/0030086 | A1 * | 2/2017 | Rodriguez Lopez | E04F 13/0812 |
| 2017/0044772 | A1 * | 2/2017 | Gestetner | E04F 13/081 |
| 2020/0080317 | A1 * | 3/2020 | Girnghuber | E04F 13/0819 |
| 2022/0195736 | A1 * | 6/2022 | Lehmann | E04F 13/0892 |
| 2023/0147713 | A1 * | 5/2023 | Singh | E04F 13/0894 52/506.05 |
| 2023/0160214 | A1 * | 5/2023 | Tani | E04F 13/0826 52/173.3 |
| 2024/0200340 | A1 * | 6/2024 | Shen | E04F 13/0805 |
| 2024/0328169 | A1 * | 10/2024 | Torrejón Puchol | E04F 13/12 |

FOREIGN PATENT DOCUMENTS

| | | | |
|---|---|---|---|
| EP | 0201630 | A2 | 11/1986 |
| ES | 2146510 | A1 | 8/2000 |
| FR | 3107290 | A1 | 8/2021 |
| IT | 201900007260 | A1 | 11/2020 |
| WO | 2016061414 | A1 | 4/2016 |

* cited by examiner

DEVICE FOR A VENTILATED FACADE

CROSS-REFERENCE TO RELATED APPLICATIONS AND PRIORITY

This patent application claims priority from International Patent Application No. PCT/ES2022/070551 filed Sep. 1, 2022, which claims priority from Spanish Patent Application No. U202131842 filed Sep. 17, 2021.

OBJECT OF THE INVENTION

The present invention relates to a device for a ventilated facade comprising panels, upright profiles intended to be attached to an outer surface of a building, and hangers.

The configuration of the device enables the hangers to be frontally assembled to the upright profiles and simultaneously offers the possibility of continuously adjusting the position in height of the hangers next to the panels hanging therefrom, since the hangers include a connecting element that is accessible from the front face of the panels, through the gap between two adjoining panels. In this way, it is possible to adjust the panels in height without needing to disassemble them and at any stage of the installation, even after having finished their installation.

BACKGROUND OF THE INVENTION

There are currently numerous assembly and installation systems for ventilated facades on the market made from boards and panels made of different materials. Ventilated facades are constructive arrangements that basically consist of using an enclosure at a distance from the outer surface of a building, placed frontally and separated from the structure of the building, creating a single and continuous chamber around the entire building.

In this type of system, both the cost of the system and the regularity with regard to the distribution of elements and, especially, the separation lines between them are of great importance: the separations between adjoining panels create lines that run along the facade, and the parallelism and regularity thereof is what determines the quality of the installation carried out and, therefore, of the system at a visual level. In order for these two objectives to be met, the systems must offer simplicity of installation and high quality in the manufacture thereof that define simple, streamlined assembly and installation processes and that define the position of the panels with respect to each other as regularly as possible.

Due to the fact that the aesthetics of the facade system defines the quality thereof, there is a need to adjust and regulate the height of the panels during the installation thereof, which can occur both at the time of the initial installation of the hanger on the upright, and after its final securing thereto. It can also be detected after assembling the panels to the hangers. In these cases, the current solution consists of disassembling portions of the installed facade, with the impact that this entails in terms of costs and required installation time.

For example, document EP0201630A2 discloses a system for assembling panels to a facade with a device for a vertical upright. However, the possibility of position adjustment after assembling the panel to the substructure is not provided. Document ES2146510A1 discloses a system of brackets and hanging points for ceramic panels, which are adjustable in height by means of slots and bolts, but which, however, are not adjustable after the installation of the panels. Likewise, document PCT/US2015/055831 discloses a regulation system with reliefs made in the hanging part of the panel. The hanging parts are assembled to horizontal profiles on the facade, so that only prior adjustment is possible, but access to the adjustment device is not possible after assembling the panels to the facade.

Thus, the systems known in the state of the art do not simultaneously allow the frontal assembly of the components to the uprights together with the possibility of their adjustment in height during and after the final assembly.

The systems available today that allow the adjustment in height of the hanging components thereof require their installation in a ribbed manner. The ribbed assembly implies that the components of a section or several consecutive upright sections, the length of which can be several metres, must be inserted from one of the ends thereof. This usually means that, due to the effect of gravity, the components tend to accumulate in the lower portion of the installation, and then they must be manually brought closer to their final position from the point where they were left along the channel of the upright. Bearing in mind that the upright sections are usually several metres long, this circumstance is usually the cause of time losses as well as errors that are difficult to correct, which end up delaying the work and making the installation more expensive.

In addition, in currently existing systems, in the event of having to rectify the position of the panels that are already installed, it is not possible to do so without having to alter other elements located on the same upright, reason for which at least partial disassembly of the facade is required, with the aforementioned impact on costs and time.

Additionally, most systems have a high number of components, making them more expensive to manufacture and more difficult to install on the facade, where the handling of multiple components simultaneously with the tools required for the installation thereof represents an added difficulty for installers.

Document DE102021103756 relates to an adapter for holding facade elements on a building, wherein the adapter has a U-shaped cross section with a base leg and two holding legs arranged essentially at right angles thereto. The base leg has at least two fastening elements for the non-positive and/or positive fastening of a support profile arranged on the outer wall, the holding legs each having a preferably U-shaped recess for optionally receiving retaining bolts of a facade element, and between the retaining legs a support bolt is provided for optionally receiving retaining grooves of a facade element.

DESCRIPTION OF THE INVENTION

The present invention relates to a device for a ventilated facade, comprising a plurality of panels provided with at least two hooking elements that extend from the internal portion of the panel and at least one upright profile having a substantially U-shaped section and which is intended to be attached to a building, wherein the upright profile is provided with a web from which at least one profile guide element extends and two lateral wings that extend from the web.

The device comprises a hanger for each hooking element that is frontally secured and with the possibility of sliding to the upright profile, which is configured to hold the panel. Said hanger is provided with a central cavity, a hanger guide element that engages with the profile guide element in an assembly situation, and a hole intended to house a connecting element, wherein the hooking element is housed in the central cavity in an assembly situation, enabling the hanger to be frontally assembled to the upright profile and access to the connecting element at any time during assembly.

The frontal assembly of the components is relevant since it allows adding or removing elements from the facade at any time as required, especially in the event of having to modify the configuration of some element that is among others that are already secured in position. The facade thus configured enables the hanging elements to be assembled to the uprights frontally to the facade, once the uprights have already been installed therein.

After the position adjustment, and with the hangers already in their definitive location, the hangers are secured in position on the upright profiles by means of the connecting element, which is accessed from the front face thereof. This element is inserted into the geometry provided for this purpose by the vertical upright profile and generates a solid mechanical joint between the hanger and the upright.

The connecting element, which can be a screw, is later accessible from the outside of the facade through the space between two adjoining panels, so that it is possible to loosen the mechanical joint between the hanger and the upright after having completed the panel installation. This enables the hanger to be moved with respect to the upright profile, adjusting its position on the same in order to later be secured again to the upright profile in the definitive position, without diminishing the quality of the mechanical joint that is achieved.

Likewise, the upright profile may comprise a central wing that extends from the web in the direction opposite to the lateral wings and the device may comprise a bracket intended to attach the upright profile to the building. Specifically, the bracket may comprise a flange that houses the central wing of the upright profile in an assembly situation, holding it.

The brackets can be of different heights, thus enabling the distance from the panel to the facade to be adjusted to enable insulation layers to be assembled between them, as well as the ventilation of the whole.

The hanger may comprise a vibration damper, which can be a board that partially embraces the hanger, which produces an elastic interference between the panel and the hanger, enabling one to be assembled on top of the other, but eliminating plays that could generate vibrations and noise in the device, wherein the board may be polymeric.

With all of the foregoing, the following substantial advantages of this device for a ventilated facade compared to the devices currently used are confirmed.

Firstly, the hangers are assembled frontally, which is an advantage over devices that require the assembly of ribbed components since it makes it possible to correct errors caused by having placed an incorrect number of components on a given upright without having to partially disassemble the facade to do so.

Thus, the set of front assembly features together with the pre-positioning, by clipping interference or by screw approximation, enables the hanging components to be placed directly in the final position thereof without movement along the uprights, opposed to the ribs that are inserted at an end, accumulate under the profile and have to be manually moved again during installation to the final position.

Another advantage is that the assembly of the facade is simplified, since a smaller number of components are required, and moreover, since the hanger is a single component and both the damper and the mechanical securing element can be provided installed in the hanger, the need to handle multiple elements at the same time with the added difficulty of having to simultaneously use tools is avoided. This represents savings both in material and in the time required for the assembly of the facade.

Lastly, the device for a ventilated facade provides the possibility of adjusting the height without disassembling the panels, in the event that at any time during the installation it is detected that there has been an error in the placement of the hangers. Even when they are already definitively secured to the upright profile and with the panel installed, it is possible to access the mechanical securing element securing the hanger to the profile in order to loosen it, freeing said connection and allowing the position of the hanger to be newly adjusted before definitively securing it again to the upright profile. This possibility of adjustment compensates for construction defects or misalignments resulting from errors in the installer's approach, the installation process of the device or even the manufacture of the components thereof.

DESCRIPTION OF THE DRAWINGS

As a complement to the description provided herein, and for the purpose of helping to make the features of the invention more readily understandable, in accordance with a preferred practical exemplary embodiment thereof, said description is accompanied by a set of drawings constituting an integral part of the same, in which by way of illustration and not limitation, the following has been represented.

PREFERRED EMBODIMENT OF THE INVENTION

Figure 1:
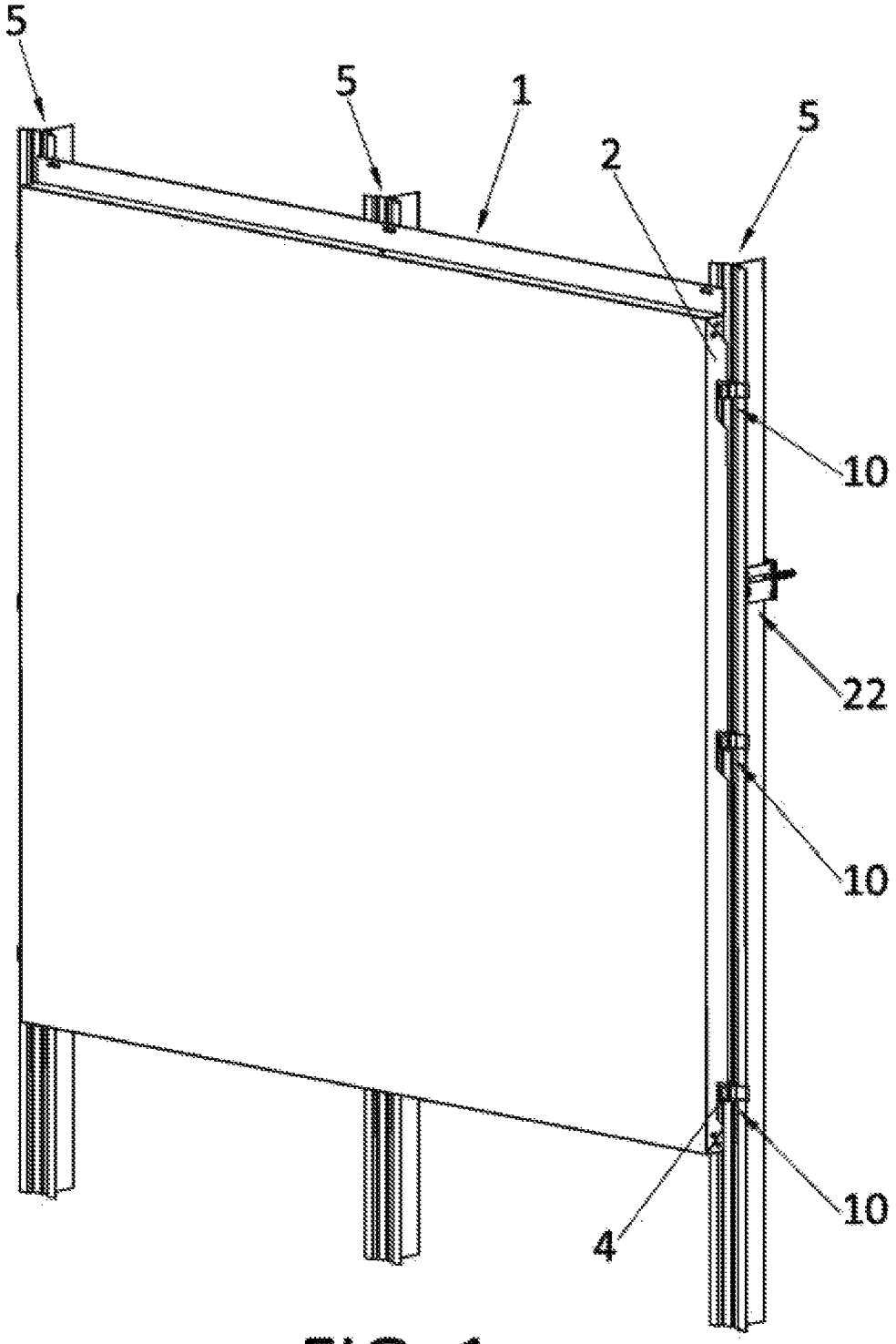
FIG. 1 shows a perspective view of a detail of a device for a ventilated facade.

FIG. 1 shows a perspective view of a detail of a device for a ventilated facade, according to the present invention, wherein a panel (1) is shown provided with several hooking elements (4). The facade of the embodiment shown comprises three U-shaped upright profiles (5) that are intended to be attached to a building and a hanger (10) for each hooking element (4) that is secured to the upright profile (5) wherein the hanger (10) holds the panel (1) in an assembly situation.

The panel (1) comprises longitudinal protrusions (2) on the internal portion of the panel (1) from which the hooking elements (4) extend. A bracket (22) can also be seen attached to the upright profile (5) and which is intended to be attached to the building, attaching the upright profile (5), by the rear portion thereof, to the building.

Figure 2:
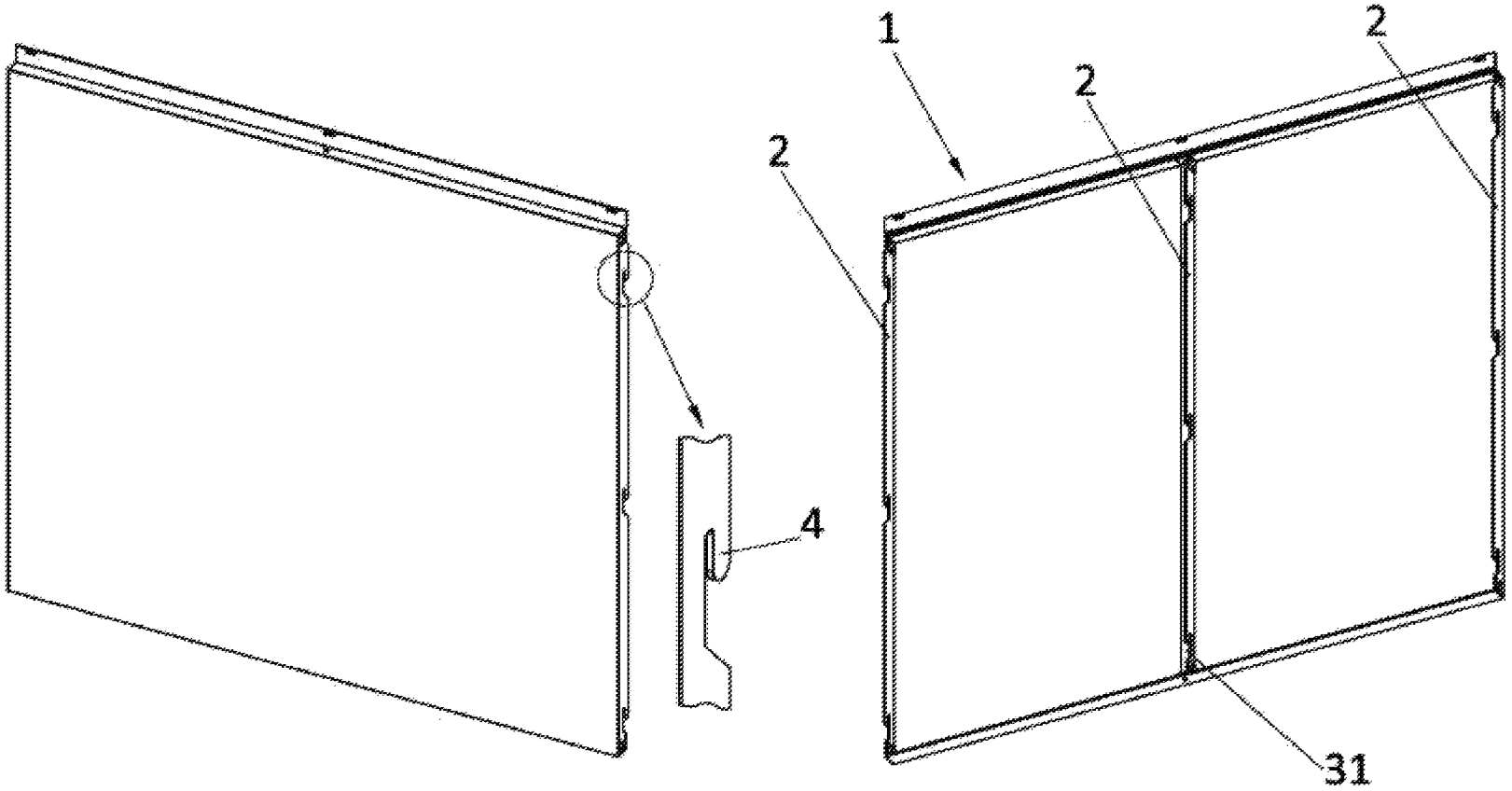
FIG. 2 shows a perspective view of two panels represented from the inner portion and the outer portion thereof.

FIG. 2 shows a perspective view of two panels (1) represented from the inner left portion and the outer right portion thereof. The three longitudinal protrusions (2) are two longitudinal protrusions (2) arranged on the edges of the panel (1) and a longitudinal protrusion (2) in the central area, acting as a stiffener, wherein the panel (1) comprises three hooking elements (4) in each longitudinal protrusion (2) and the facade comprises three upright profiles (5), the number of elements being able to change depending on the dimensions of the panel (1).

Figure 3A:
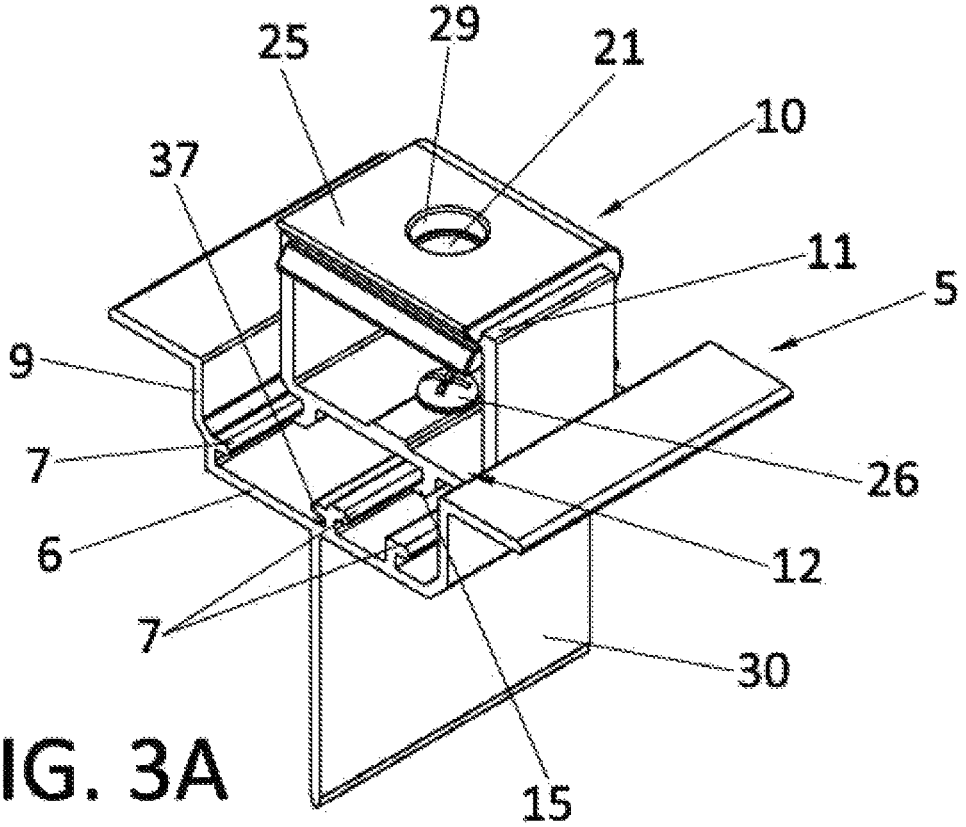
FIG. 3A shows a perspective view of a first configuration of a section of an upright profile, the vibration damper, a hanger and a connecting element.

FIG. 3A shows a perspective view of a first configuration of a section of an upright profile (5), a hanger (10) and a connecting element (26). The upright profile (5) is provided with a web (6) from which a profile guide element (7, 8) and two lateral wings (9) extend.

The hanger (10) is secured to the upright profile (5) and is configured to hold the panel (1). The hanger (10) is provided with an outer section (11) and an inner section (12, 13) facing the outer section (11) from which a hanger guide element (15, 16) extends that engages with the profile securing element (7, 8) and a hole (18, 19) intended to house a connecting element (26). The central cavity (3) is defined between the two sections (11, 12, 13) wherein the hooking element (4) of the panel (1) is housed.

Specifically in the embodiment shown, the profile securing element (7, 8) is made up of a plurality of outgoing ribs (7) that extend in the direction of the lateral wings (9) and the inner section (12,13) is a first inner section (12) provided with a hanger guide element (15, 16) made up of a plurality of incoming ribs (15) complementary to the outgoing ribs (7) and a first hole (18) arranged in the central position with respect to the width of the inner section (12). The outer section (11) in turn comprises a first through hole (21) that is coaxial to the first hole (18).

The hanger (10) comprises a vibration damper (25) with a second through hole (29) coaxial to the first through hole (21) such that there is direct and frontal access to the hanger (5) by adjusting the connecting element (26).

Figure 3B:
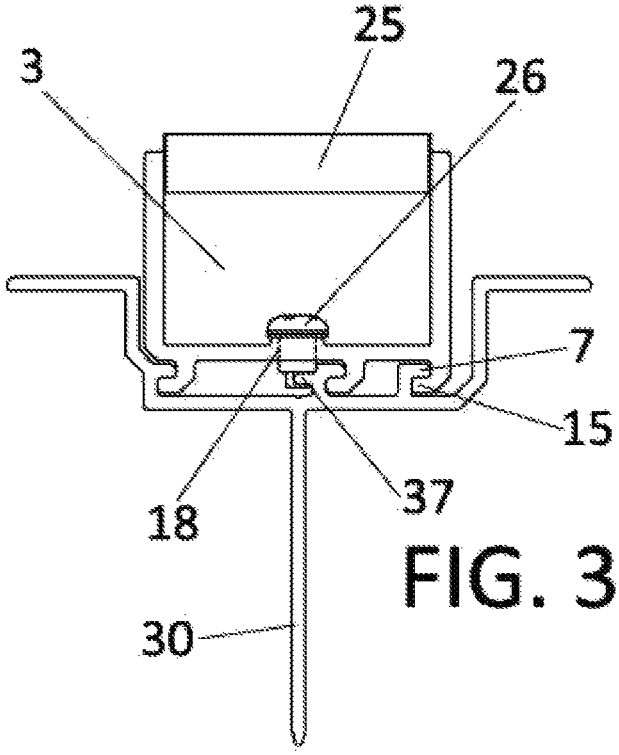
FIG. 3B shows a cross-sectional view of FIG. 3A.

FIG. 3B shows a cross-sectional view of FIG. 3A, according to the present invention, in which the connection between the outgoing ribs (7) and the incoming ribs (15) and the connecting element (26) which is a screw housed in the first hole (18) are shown.

It can be seen that one of the outgoing ribs (7), the one in the central portion, is provided with a longitudinal projection (37) that generates an interference joint that cannot be disassembled between the hanger (10) and the connecting element (26), since when inserting the tip of the connecting element (26), which is a screw, it partially interferes with the longitudinal projection (37) by removing material, blocking the position of the hanger (10).

Figure 4A:
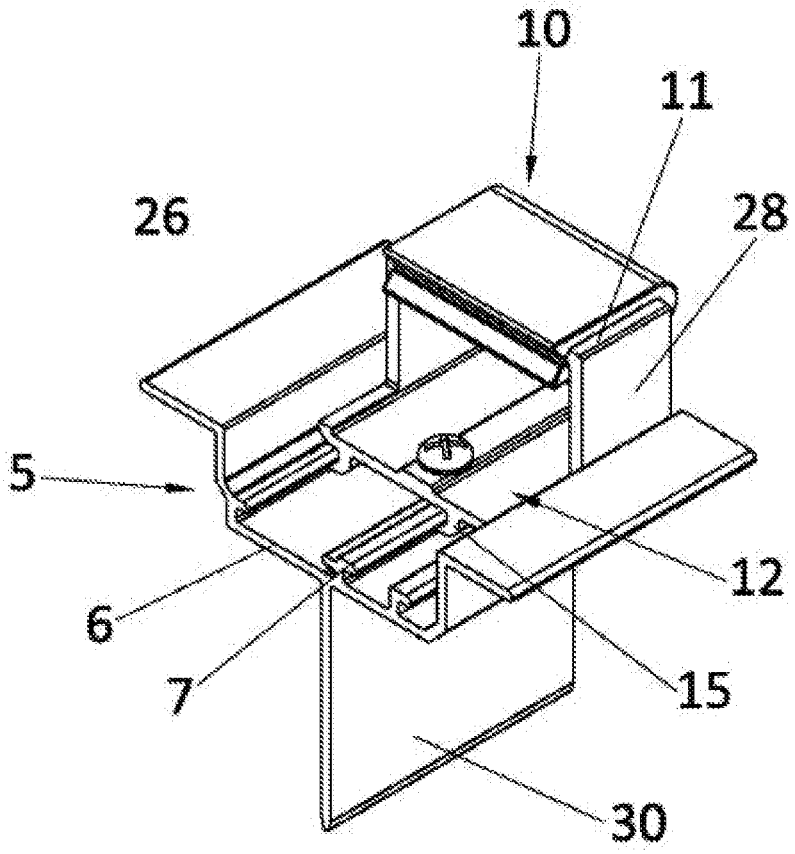
FIG. 4A shows a perspective view of a second configuration of a section of an upright profile, the vibration damper, a hanger and a connecting element.
Figure 4B:
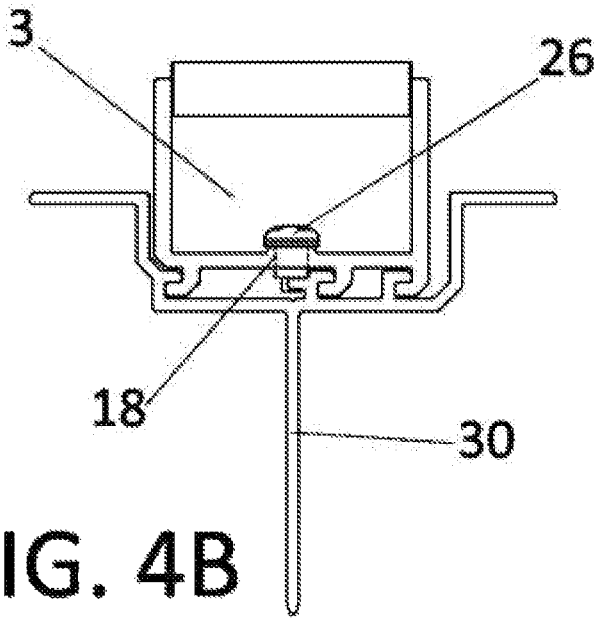
FIG. 4B shows a cross-sectional view of FIG. 4A.

FIG. 4A shows a perspective view of a second configuration of a section of an upright profile (5), a hanger (10) provided with the first internal section (12) and a connecting element (26). In the embodiment shown, the inner section (12) is longer than the outer section (11), access to the first hole (18) and therefore to the connecting element (26) being free. FIG. 4B shows a cross-sectional view of FIG. 4A.

Figure 5A:
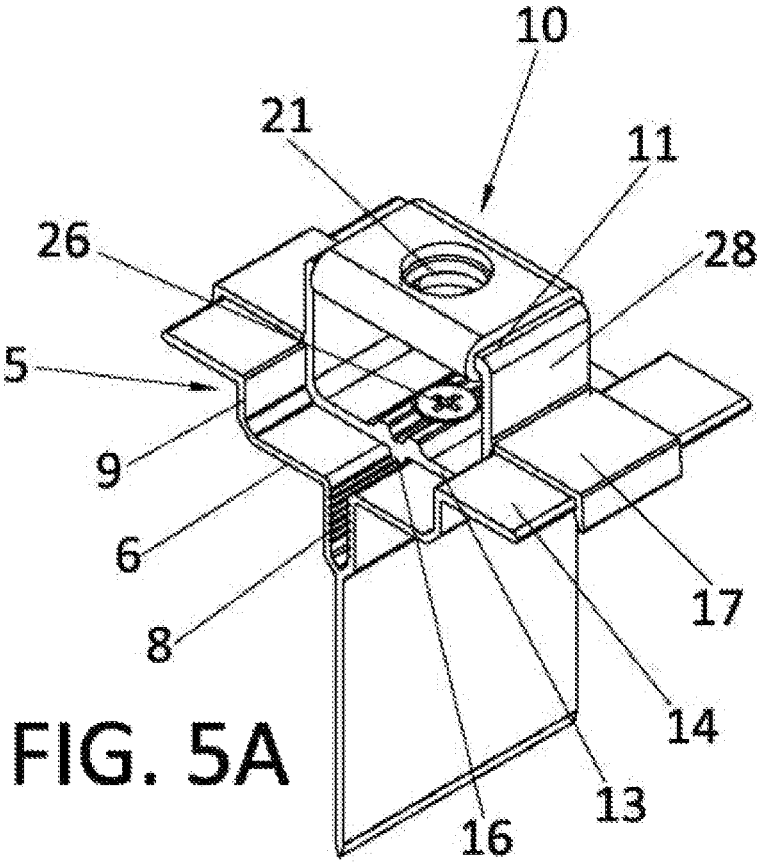
FIG. 5A shows a perspective view of a third configuration of a section of an upright profile, the vibration damper, a hanger and a connecting element.
Figure 5B:
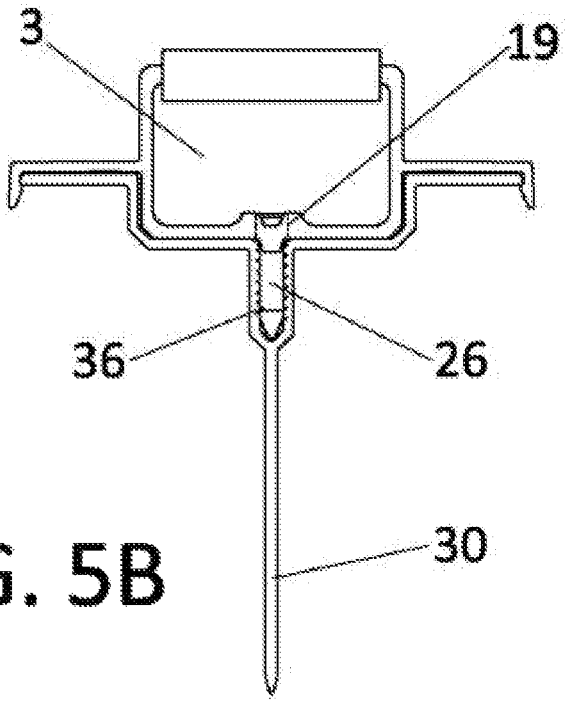
FIG. 5B shows a cross-sectional view of FIG. 5A.

FIG. 5A shows a perspective view of a third configuration of a section of an upright profile (5), a hanger (10) and a connecting element (26), wherein the profile securing element (7, 8) is a U-shaped ribbed projection (8) that extends in the direction opposite to the lateral wings (9). The inner section (12,13) is a second inner section (13) provided with a hanger guide element (15, 16) which is a central projection (16) that can be housed in the ribbed projection (8) and with a second hole (19).

Unlike the vibration dampers (25) shown in the previous figures, the vibration damper (25) of the third configuration does not have a lateral opening, but covers the outer section (11) and has a lower slot. The upright profile (5) comprises a central wing (30) that extends in the direction opposite to the lateral wings (9).

Figure 6:
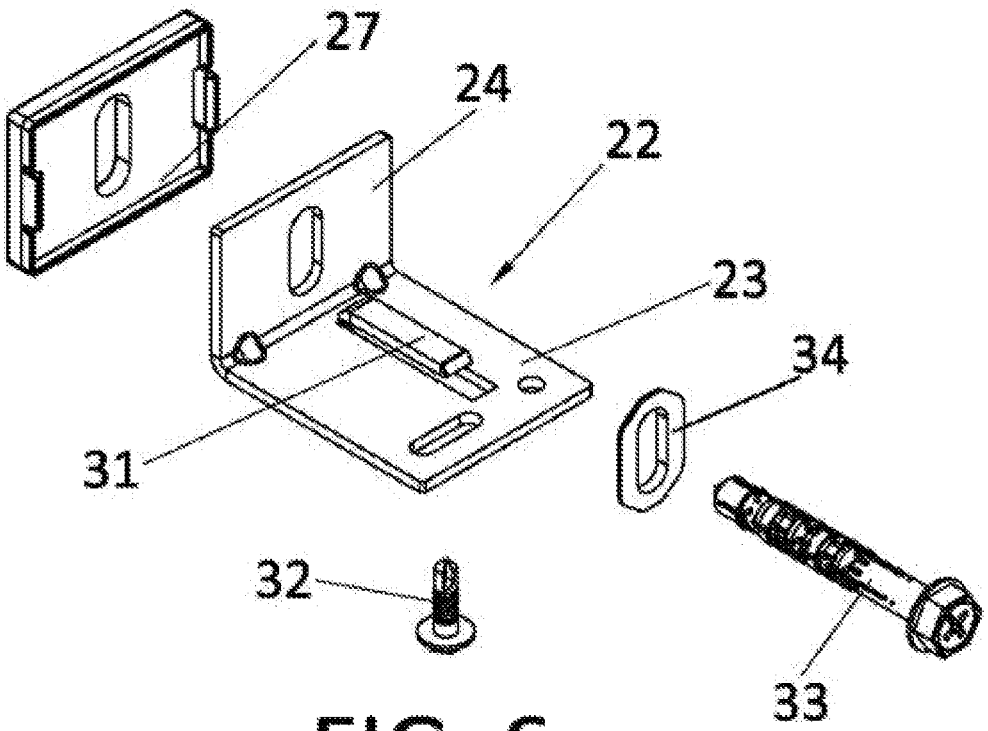
FIG. 6 shows an exploded view of a bracket.

FIG. 6 shows an exploded view of a bracket (22), the function of which is to attach the upright profile (5) to the building. The bracket (22) is provided with a first surface (23) and a second surface (24) perpendicular to the first surface (23) which is intended to be attached to the building. The bracket (22) comprises a flange (31) that extends from the first surface (23) and houses the central wing (30) in an assembly situation.

The bracket (22) comprises mechanical retaining elements (32,33), such as a first screw (32) and a second screw (33) and a plastic spacer (34) intended to be placed between the bracket (22) and the facade. The bracket (22) further comprises an insulating polymeric spacer (27) that embraces the second surface (24).

Figure 7:
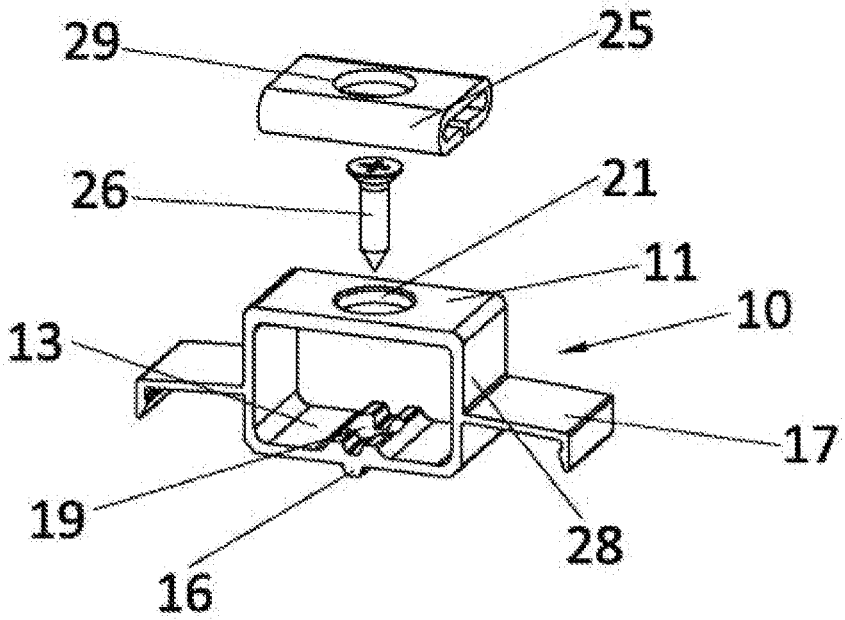
FIG. 7 shows an exploded view of the hanger.

FIG. 7 shows an exploded view of the hanger (10), the connecting element (26) and the vibration damper (25) with the second through hole (29) coaxial to the first through hole (21) and lateral reinforcements (17) that extend from the lateral sections (28) of the hanger (10).

Figure 8A:
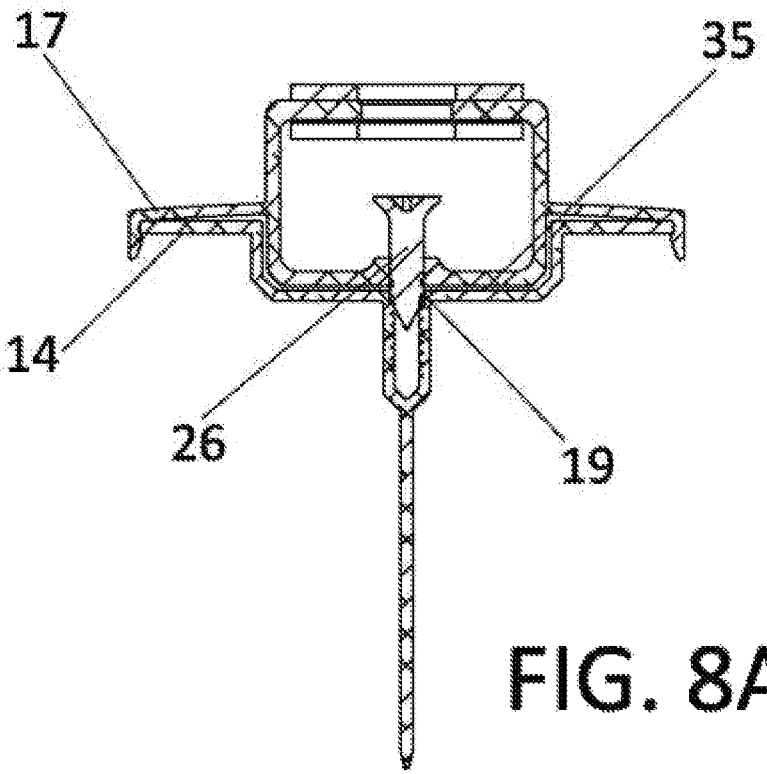
FIG. 8A shows a cross-sectional view of the connecting element, the vibration damper and the upright profile in an intermediate assembly situation.

FIG. 8A shows a cross-sectional view of the connecting element (26), the vibration damper (25) and the upright profile (5) in an intermediate assembly situation, wherein the latter comprises two outer wings (14) that extend in a direction opposite to each other and are perpendicular to the lateral wings (9) and the hanger (10) comprises two lateral sections (28) that attach the outer section (11) and the inner section (12, 13) and the lateral reinforcements (17) that partially embrace the outer wings (14) of the upright profile (5).

Figure 8B:
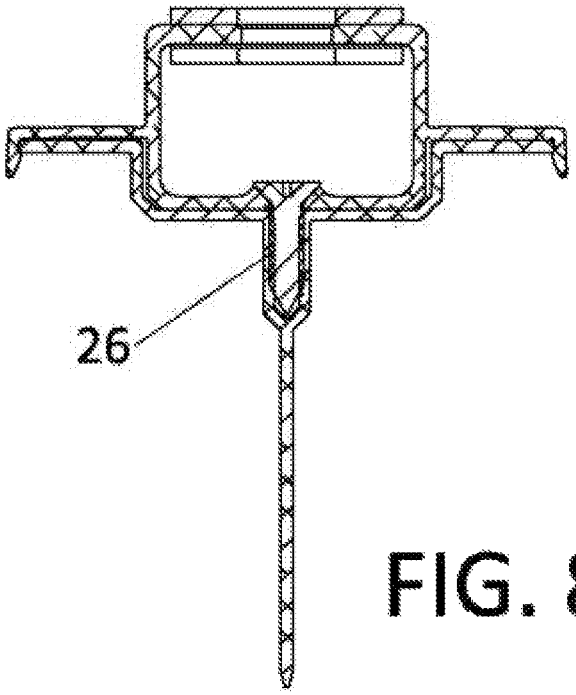
FIG. 8B shows a cross-sectional view of the connecting element, the vibration damper and the upright profile in a final assembly situation.

In FIG. 8A, the connecting element (26) is in a situation prior to final assembly, while FIG. 8B shows a cross-sectional view of a connecting element (26) fully inserted into the ribbed projection (8) in a final assembly situation.

The lateral reinforcements (17) are slightly inclined with respect to the lateral sections (14) such that in an intermediate assembly situation an interstice (35) is generated between the hanger (10) and the upright profile (5), in addition to an interference that generates friction between the inside of the lateral reinforcements (17) and the ends of the outer wings (14) that allows the hangers (10) to remain preliminarily positioned on the upright profile (5) without sliding and without having to secure them by means of the connecting element (26).

When the connecting element (26) is tightened and inserted into the ribbed projection (8), thus securing the hanger (10), the same is prevented from being stressed until it breaks. The lateral reinforcements (17) are slightly deformed, but they keep holding the upright profile (5) by the sides, thus preventing the screw-type connecting element (26) from deforming the upright profile (5) by opening it and preventing the threaded connection from losing strength.

Figure 9:
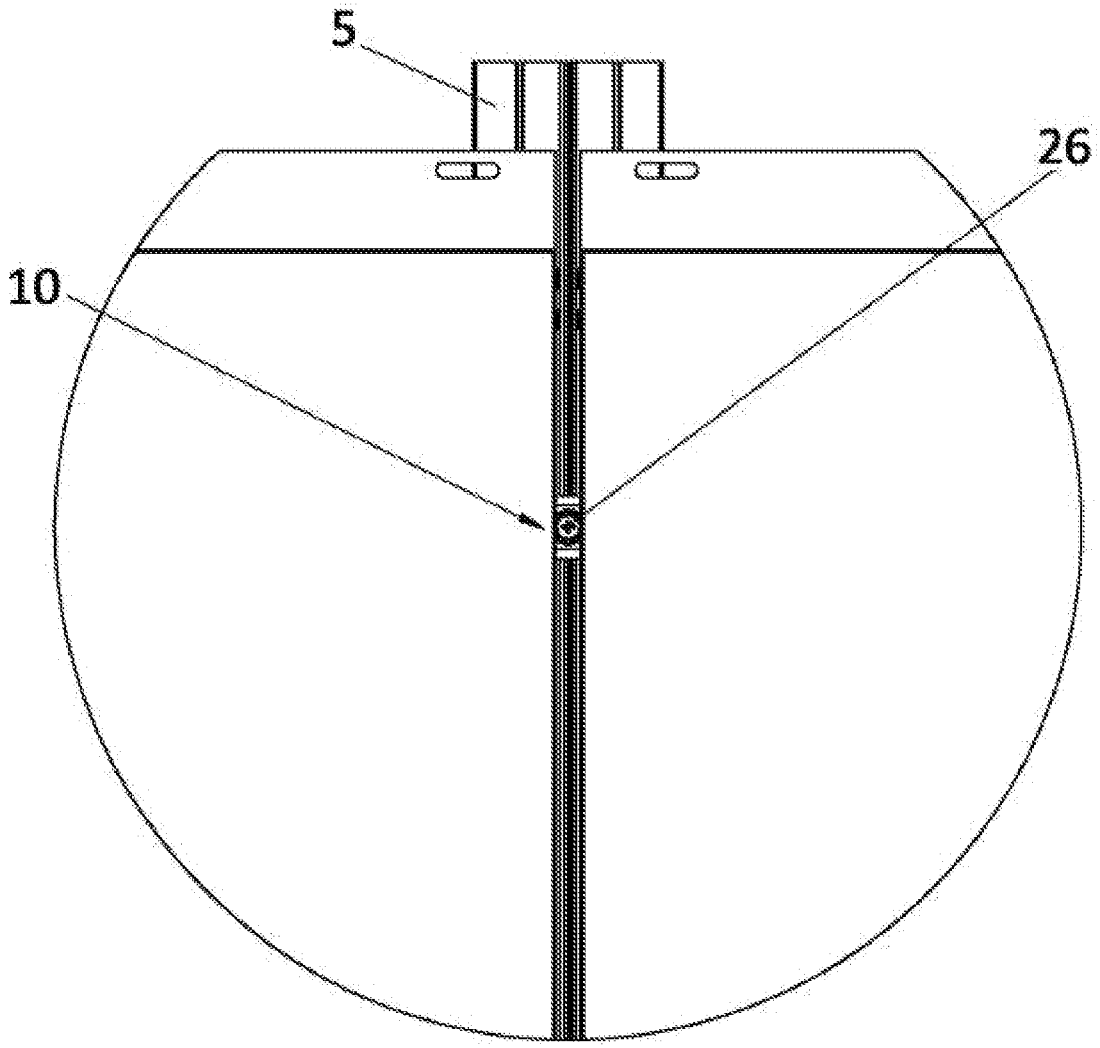
FIG. 9 shows a detailed view of a device for a ventilated facade provided with two panels.

FIG. 9 shows a detailed view of a device for a ventilated facade provided with two panels (1), showing the possibility of accessing the connecting element after assembly of the panels (1). A hanger (10) can be seen that is secured to the upright profile (5) and that is holding the two panels (1). The panels (1) have an outer or front area that is the visible portion, and an inner or rear area that the portion is facing the building. The connecting element (26) is accessible from the front of the facade once the panels (1) are already installed, being able to adjust the height of the hanger (10) at any time and, therefore, the height of the panels (1).

The invention claimed is:

1. A device for a ventilated facade, comprising:

a plurality of panels provided with at least two hooking elements that extend from the panels;

at least one upright profile having a substantially U-shaped section configured to be attached to a building, wherein the upright profile is provided with:

a web from which at least one profile guide element extends; and two lateral wings that extend from the web;

a hanger configured to receive one of the hooking elements and secured to the web of the upright profile and configured to hold one of the panels, the hanger further comprising:

a central cavity for receiving one of the hooking elements, at least one a hanger guide element that engages with the at least one profile guide element to secure the hanger to the upright profile and allow for vertical adjustment of the at least one hanger guide element along the at least one profile guide element before and after the hanger is secured to the upright profile, a hole configured to receive a connecting element to secure the hanger to the upright profile, and an outer section and an inner section facing the outer section defining the central cavity therebetween, wherein the hanger guide element extends from the inner section and the hole is arranged in the inner section, wherein:

sides of the hanger between the outer section and the inner section are open for access to the central cavity and the connecting element, the outer section comprises a first through hole that is coaxial to the hole, the hanger comprises a vibration damper that covers the outer section of the hanger, and the vibration damper is a polymeric board comprising a second through hole coaxial to the first through hole.

2. The device of claim 1, wherein the profile guide element comprises a plurality of outgoing ribs that each extend toward one of the lateral wings.

3. The device of claim 2, wherein one of the outgoing ribs is provided with a longitudinal projection, a tip of the connecting element abuts with the longitudinal projection when the connecting element is in the hole.

4. The device of claim 1, wherein the inner section is a first inner section provided with the hanger guide element made up of a plurality of incoming ribs complementary to the outgoing ribs and the hole.

5. The device of claim 1 wherein the inner section is longer than the outer section, and the hole is located in a portion of the inner section spaced from the cavity such that the hole is accessible outside the cavity.

6. The device of claim 1, wherein the profile guide element is a U-shaped ribbed projection that extends in a direction opposite to the lateral wings.

7. The device of claim 6, wherein the ribbed projection is provided with notches configured to receive the connecting element.

8. The device of claim 6, wherein the inner section is a second inner section provided with the hanger guide element which is a central projection that is configured to be received in the ribbed projection and with the hole in the ribbed projection and configured to receive the connecting element.

9. The device of claim 8, wherein the upright profile comprises two outer wings that extend in a direction opposite to each other and are perpendicular to the lateral wings and the hanger comprises two lateral sections that attach the outer section and the second inner section and lateral reinforcements that extend from the lateral sections of the hanger and that partially embrace the outer wings of the upright profile being clipped thereto and configured to be pre-positioned.

10. The device of claim 9, wherein the lateral reinforcements are slightly inclined with respect to the lateral sections and in an intermediate assembly situation an interstice is defined between the hanger and the upright profile and in a final assembly situation said interstice is removed.

11. The device of claim 1, wherein the panels comprise vertical longitudinal protrusions in a rear area thereof from which the hooking elements extend.

* * * * *